United States Patent [19]

Mastalski

[11] Patent Number: 4,962,620

[45] Date of Patent: Oct. 16, 1990

[54] GUY MARKER CONSTRUCTION

[75] Inventor: Henry Mastalski, Orange Park, Fla.

[73] Assignee: Florida Wire and Cable Company, Jacksonville, Fla.

[21] Appl. No.: 493,421

[22] Filed: Mar. 14, 1990

[51] Int. Cl.[5] ..... E64H 12/20

[52] U.S. Cl. ..... 52/147

[58] Field of Search ..... 52/146, 147, 148

[56] References Cited

U.S. PATENT DOCUMENTS

| | | | |
|---|---|---|---|
| Re. 19,639 | 12/1930 | Miller | 52/147 |
| Re. 19,845 | 2/1936 | Miller . | |
| 1,627,423 | 5/1927 | Bierce | 52/147 |
| 1,902,945 | 3/1933 | Blackburn . | |
| 3,089,567 | 5/1963 | Sullivan . | |
| 3,173,519 | 3/1965 | Sullivan . | |
| 3,302,346 | 2/1967 | Williams et al. | 52/147 |
| 3,782,059 | 1/1974 | Reed | 52/147 |
| 3,897,664 | 8/1975 | Bogese | 52/147 |
| 3,926,141 | 12/1975 | Taylor | 116/114 R |
| 3,958,379 | 5/1976 | Williams et al. | 52/145 |
| 3,999,340 | 12/1976 | Bogese et al. | 52/147 |
| 4,135,336 | 1/1979 | Bogese | 52/147 |
| 4,223,491 | 9/1980 | Vaughn | 52/147 |
| 4,231,208 | 11/1980 | Willox | 52/741 |
| 4,453,353 | 6/1984 | Killop et al. | 52/147 |
| 4,462,141 | 7/1984 | Bogese | 24/16 PB |
| 4,638,611 | 1/1987 | Vaughn | 52/147 |

FOREIGN PATENT DOCUMENTS

| | | | |
|---|---|---|---|
| 991953 | 5/1965 | United Kingdom | 52/147 |

*Primary Examiner*—John E. Murtagh

*Attorney, Agent, or Firm*—Ira S. Dorman

[57] ABSTRACT

A guy marker assembly consists of a mounting fixture for securement to the guy cable, and a marker sleeve which is rotatably mounted thereupon in an axially fixed position.

13 Claims, 3 Drawing Sheets

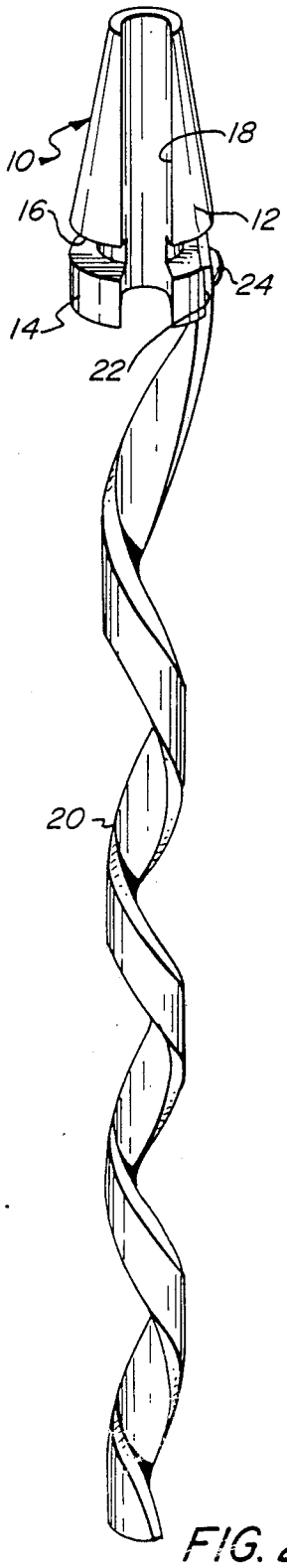
FIG. 2
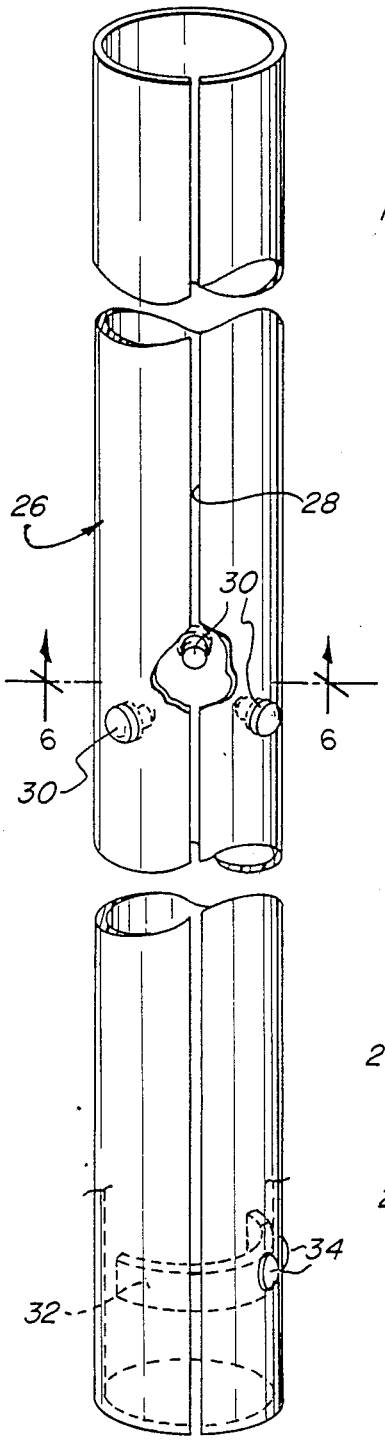
FIG. 3
FIG. 4
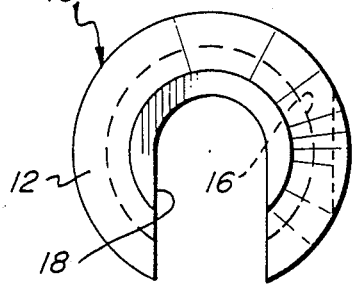
FIG. 5
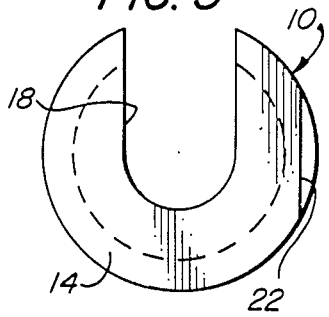
FIG. 6
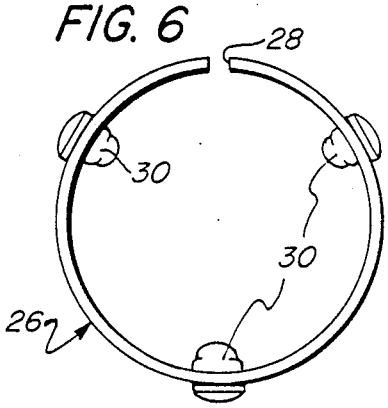
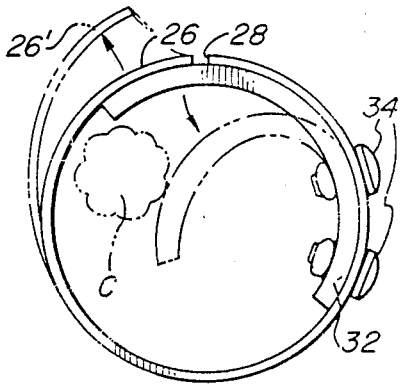
FIG. 7

GUY MARKER CONSTRUCTION

BACKGROUND OF THE INVENTION

It is common practice to enclose within tubular members the guy cables that are used for supporting telephone and utility poles. This is done as a means of increasing visibility, and of reducing the potential for harm from impact or collision with the cable. The following United States patents indicate the numerous forms that such protective enclosures have taken in the past, and describe various means that have been used for mounting them: Miller Pat. No. Re. 19,845, Blackburn Pat. No. 1,902,945, Sullivan Pat. No. 3,089,567, Sullivan Pat. No. 3,173,519, Williams et al Pat. No. 3,302,346, Reed Pat. No. 3,782,059, Bogese, II Pat. No. 3,897,664, Taylor Pat. No. 3,926,141, Williams et al Pat. No. 3,958,379, Bogese et al Pat. No. 3,999,340, Willox Pat. No. 4,231,208, Bogese, II Pat. No. 4,135,336, Vaughn Pat. No. 4,223,491, Killop et al Pat. No. 4,453,353, Bogese Pat. No. 4,462,141, and Vaughn Pat. No. 4,638,611.

A significant problem that is associated with the use of such marker devices concerns the discouragement of vandalism. Although the arrangement employed for attachment to the guy cable (also referred to as guy wires and strands) may be highly effective in any given case, one or more of the components will often have inadequate structural strength to withstand a forceful attempt at removal, causing the device simply to be destroyed in the effort.

Accordingly, it is a broad object of the present invention to provide a novel, vandal-resistant guy marker assembly.

It is also an object of the invention to provide such a marker assembly that is of relatively simple and inexpensive construction, and is relatively facile to manufacture and install.

SUMMARY OF THE INVENTION

It has now been found that the foregoing and related objects of the invention are attained by the provision of a guy marker assembly comprising, in combination, a mounting body having a lengthwise recess dimensioned to receive a guy cable disposed on the axis thereof, means for attaching the body to a guy cable so disposed, and a tubular marker member coaxially and rotatably mounted on the body. A groove extends about the mounting body between its opposite end portions and generally in a plane perpendicular to its axis, and the marker member has at least one inwardly projecting engagement element thereon, which is slidably seated within the groove of the body. The marker member is thereby affixed against relative axial displacement from the body, but is freely rotatable thereabout.

In the preferred embodiments, one of the end portions of the mounting body will be of progressively outwardly diminishing cross section (e.g., tapered) so as to provide a lead-in to the groove, over the surface of which the engagement element can slide to facilitate coaxial mounting of the marker member upon the body. Most desirably, the attaching means will comprise a preformed helical strap on the mounting body, the strap extending with its helical axis substantially coaxial with the longitudinal axis thereof. The marker member will preferably be fabricated from a resiliently deflectable material and slip along its entire length, and normally there will be a plurality of engagement elements disposed on the marker member at equidistantly spaced locations thereabout and substantially in a common plane. In addition, the marker member will usually incorporate a locking element for inhibiting withdrawal of a guy cable laterally through its slit.

The preferred form of the locking element will comprise a piece of resilient material disposed within the marker member and attached on one side of the slit, to extend thereacross with a free end portion disposed against (or at least proximate to) the inside surface of the opposite marginal portion of the member. Resilient deflection of the locking piece and/or the marginal portion of the tubular member will permit a guy cable to pass between them, thereupon becoming trapped within the marker member.

BRIEF DESCRIPTION OF THE DRAWINGS

FIG. 2 is an elevational view showing the mounting fixture by which the assembly is secured on the cable, drawn to a scale greatly enlarged from that of FIG. 1;

FIG. 3 is a fragmentary perspective view of the marker sleeve of which the assembly is comprised, drawn to the scale of FIG. 2 and having a section broken away to expose an internal feature;

FIG. 4 is plan view of the mounting body of the fixture, drawn to a further enlarged scale;

FIG. 5 is a bottom view of the mounting body;

FIG. 6 is a sectional view of the sleeve of FIG. 3, taken along line 6—6 thereof and drawn to the scale of FIGS. 4 and 5;

FIG. 7 is an end view taken from the bottom of the sleeve, showing, in phantom line, elements deflected to permit insertion cable through the sleeve slit;

DETAILED DESCRIPTION OF THE ILLUSTRATED EMBODIMENTS

Figure 1:
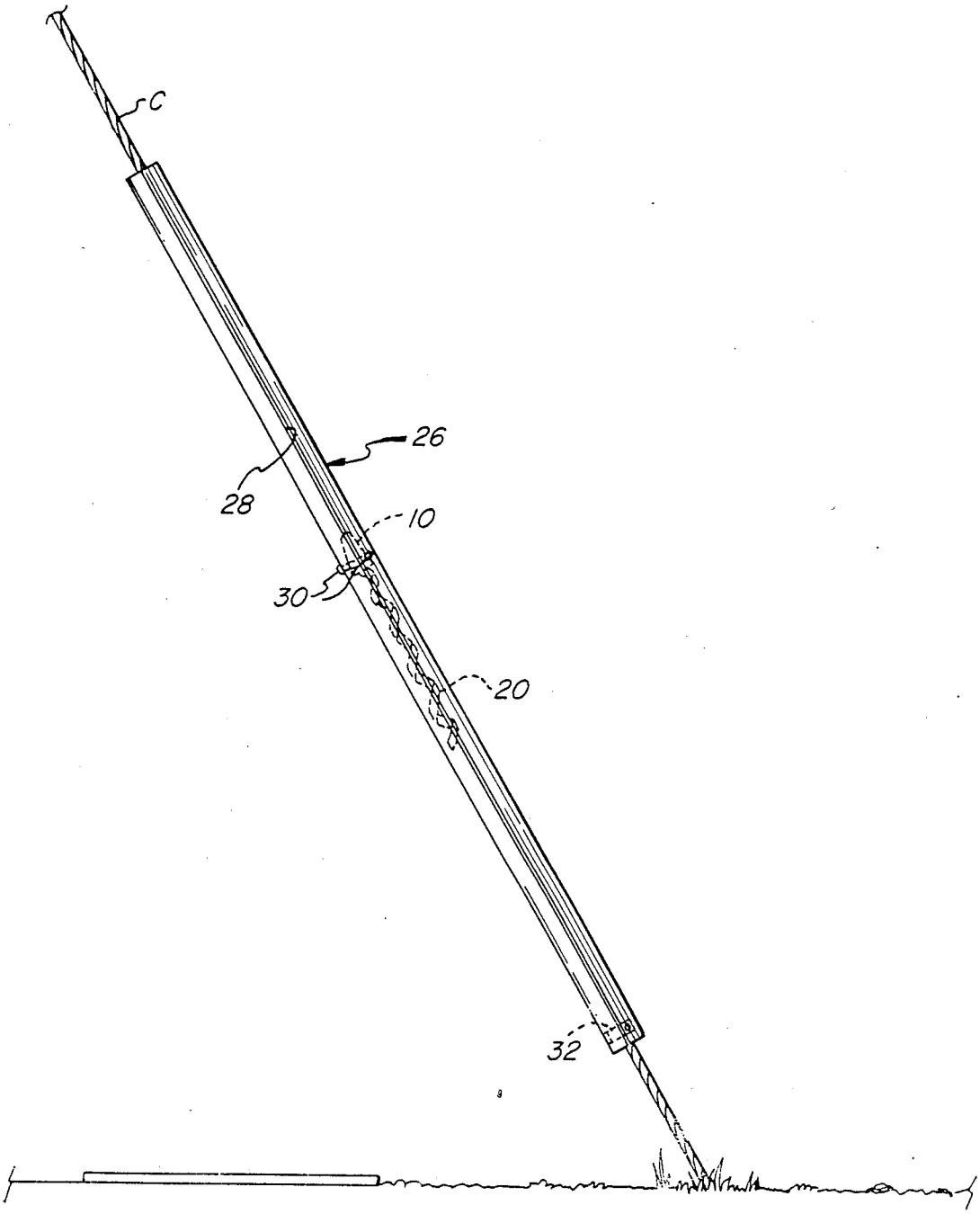
FIG. 1 is an elevational view showing the marker assembly of the invention installed upon a guy cable.

Turning now in detail to the appended drawings, therein illustrated is a guy cable marker assembly embodying the present invention, comprising a mounting fixture that includes a body, generally designated by the numeral 10. The body consists of a frustoconical upper end portion 12 and a cylindrical base portion 14, between which extends circumferentially a deep groove 16, oriented generally in a plane perpendicular to the longitudinal axis of the body. A deep longitudinal slot or channel 18 is formed into one side of the body 10, within which is received the cable C in substantially coaxial relationship.

A helical strap or pigtail 20 is attached by rivet 24 against a flat surface 22 on the base portion 14 of body 10. As is conventional (and is shown for example in the above-mentioned U.S. Pat. No. 3,958,379), the strap 20 is wrapped about the cable C to secure the fixture thereon against axial displacement, the helix being so dimensioned as to generate a level of radial force necessary to tightly grip the cable.

A plastic marker sleeve, generally designated by the numeral 26, is mounted upon the slotted body 10. The sleeve 26 is slit at 28, axially along its full length, so as to permit the marginal portions to be displaced from one another. It will be appreciated however that the gauge and composition of the material from which the sleeve is fabricated will be such as to permit separation to be achieved only through the exertion of substantial force; it will also be appreciated that the plastic material will possess a high degree of elastic memory, causing the sleeve to resume its undistorted condition when the applied force is removed. Three rivets 30 are secured within the wall of the sleeve 26 at equiangularly spaced locations thereabout and in a common plane, and a C-shaped locking strap 32, also made of a tough, resiliently deflectable plastic material, is attached adjacent the lower end of the sleeve, using a pair of rivets 34.

Figure 8:
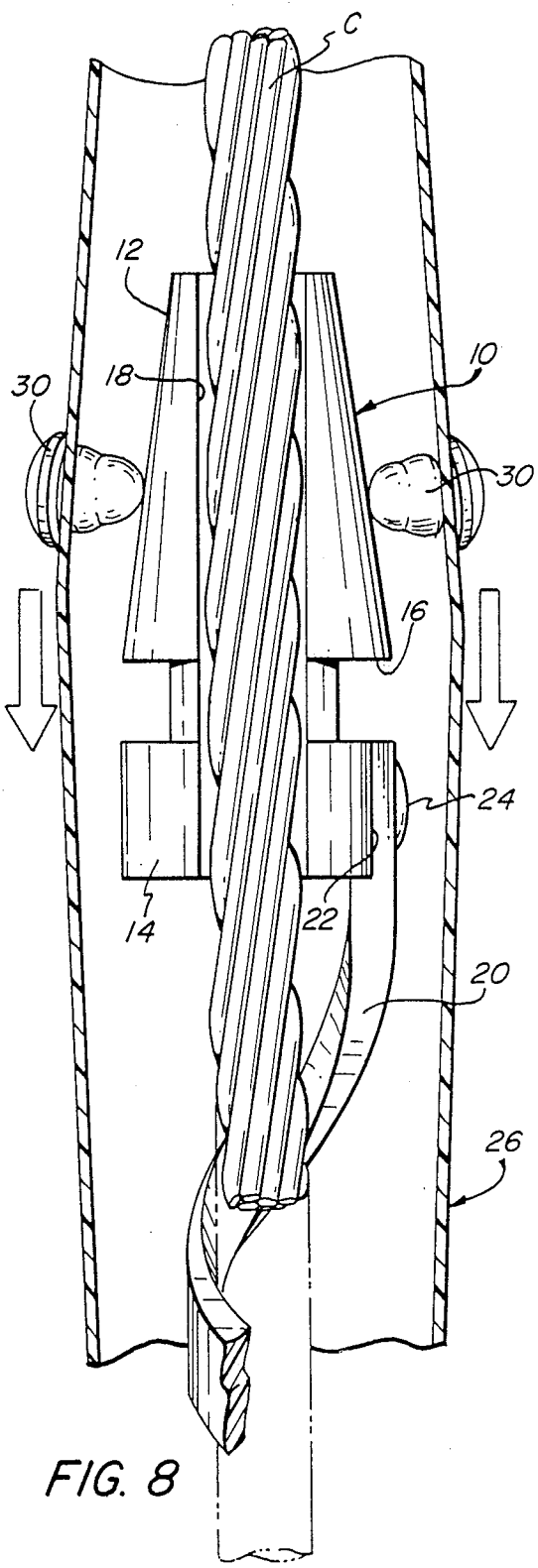
FIG. 8 is a fragmentary elevational view, in partial section and drawn to a further enlarged scale, showing the manner of mounting of the marker sleeve upon the fixture body, the body inturn being disposed on the cable.
Figure 9:
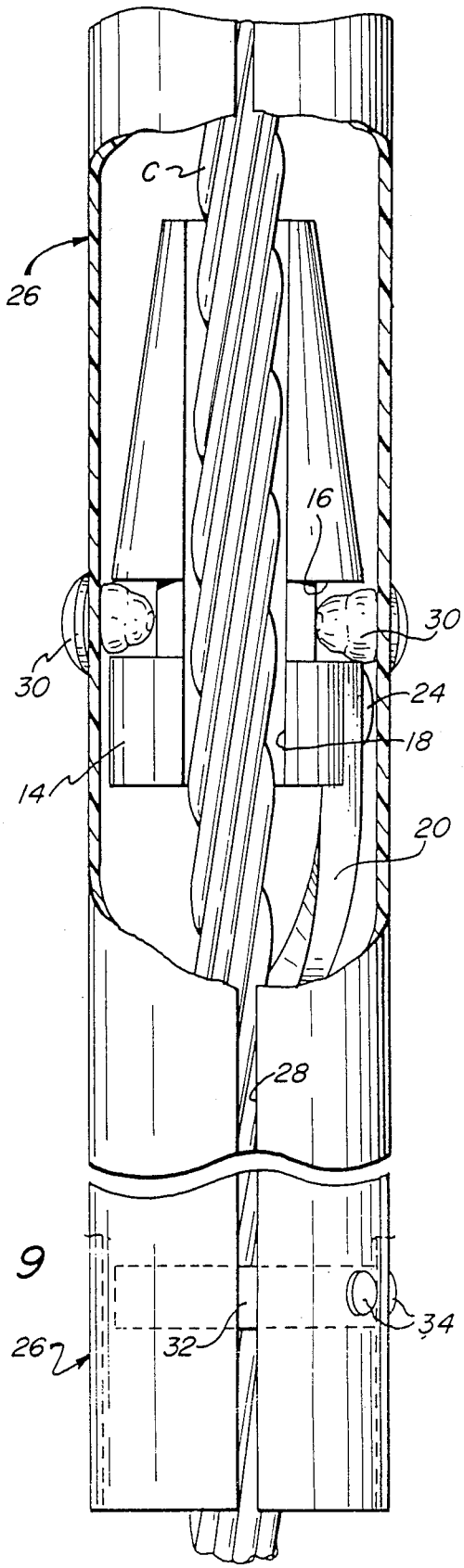
FIG. 9 is a similar view of the fully installed assembly, a portion of the marker sleeve being broken away to show the relationship of the interengaged components thereof.

The manner of assembly of the marker sleeve 26 with the previously-affixed mounting fixture is illustrated in FIGS. 8 and 9. As a first step (not illustrated) the sleeve is forced onto a section of the cable C above the fixture by inserting the guy through the slit 28, as is readily achieved due to the relatively small diameter of the cable. The sleeve is then slid downwardly over the mounting body 10, as indicated by the arrows in FIG. 8, with the frustoconical upper portion 12 of the body providing a lead-in surface upon which the tips of the rivets 30 may ride to the circumferential groove 16, and with the material of the sleeve 26 yielding as necessary to permit its expansion and facile movement of the rivets. When the rivets are brought to the level of the groove 16, the elastic memory of the sleeve material will cause them to snap into the groove, and will hold them in place to effect and maintain a secure interlock. It will be noted that the upper and lower portions 12, 14 of the body 10 are formed with angular shoulders defining the opening into the groove 16, which securely engage the rivets 30 and thereby affix the sleeve 26 against axial displacement in a highly effective manner.

The sleeve 26 will of course be freely rotatable about the mounting body 10. Vandalism committed upon devices of this kind typically entails twisting of the outer member about its longitudinal axis, ultimately causing it to break away from the gripping strap (thereby permitting ready removal from the guy cable), or causing the strap to unwind sufficiently to permit the marker to be forced upwardly on the cable. Because the sleeve 26 of the present assembly is free to rotate around the body 10, however, it effectively defeats such tampering, and thereby provides substantially increased levels of vandal protection.

As will be appreciated by reference to FIG. 7, complete insertion of the cable entails relative deflection of the marginal portion 26, at the lower end of the sleeve, and of the free end portion of the locking strap 32. After the cable is inserted, the strap 32 will resiliently return to its full-line position of FIG. 7, thereby trapping the cable and preventing its withdrawal through the slit 28.

It will be understood from the foregoing description that the components of which the assembly of the invention is comprised will normally be fabricated from tough plastics that are rigid and get resiliently deflectable; in addition, the marker sleeve will usually be of bright or light coloration, to afford appropriate visibility. The selection of suitable synthetic resinous materials will be evident to those skilled in the art; it might be mentioned by way of example, however, that appropriate materials for the sleeve, for the helical strap, and for the slotted cone are high-density polyethylene, polyvinyl chloride, and nylon, respectively.

Typically, the marker sleeve will be provided as a cylindrical member, approximately $1\frac{1}{4}$ inches in diameter and eight feet long. Although the rivets shown in the illustrated embodiment provide entirely satisfactory means for engaging the mounting cone, in some instances it may be desirable to substitute other elements, e.g., arcuate plastic pieces attached to the sleeve and dimensioned for similar interengagement within the groove. In any event, the particular form and construction of the several components and elements of which the assembly is comprised may of course vary from those illustrated and specifically described, without exceeding the scope hereof.

Thus, it can be seen that the present invention provides a novel guy marker assembly that is highly resistant to vandalism. The marker assembly is of relatively simple and inexpensive construction, and is relatively facile to manufacture and convenient to install.

Having thus described the invention, what is claimed is:

1. A guy marker assembly comprising, in combination:

a mounting body with a longitudinal axis and opposite end portions thereon, said body having a recess extending along the full length thereof, dimensioned to receive a guy cable therewithin disposed substantially on said axis, and having a groove extending entirely thereabout between said end portions and generally in a plane perpendicular to said axis thereof;

means for attaching said mounting body to a guy cable so disposed; and a tubular marker member coaxially mounted on said body and dimensioned and configured for rotation thereabout, said marker member having at least one inwardly projecting engagement element thereon slidably seated within said groove of said body, said engagement element engaging said marker member and body against relative axial displacement while permitting relative rotation therebetween.

2. The assembly of claim 1 wherein one of said end portions of said mounting body is of progressively diminishing cross sectional dimensions outwardly from said groove to one end thereof, said one end portion thereby providing a lead-in to said groove, over the surface of which said engagement element of said marker member can slide to facilitate coaxial mounting thereof upon said body.

3. The assembly of claim 1 wherein said mounting body has a slot extending longitudinally along one side thereof to provide said cable-receiving recess.

4. The assembly of claim 1 wherein said means for attaching comprises a preformed helical strap on said mounting body, said strap extending from said body with its helical axis substantially coaxial with said longitudinal axis thereof, said strap being adapted for wrapping about a guy cable for tightly gripping the same.

5. The assembly of claim 1 wherein said marker member is fabricated from a resiliently deflectable material, and is slit along its full length.

6. The assembly of claim 5 wherein there are a plurality of said engagement elements, said elements being disposed at equidistantly spaced locations about said marker member and substantially in a common plane oriented perpendicular to the longitudinal axis thereof.

7. The assembly of claim 5 wherein said marker member has a locking element thereon for inhibiting withdrawal of a guy cable laterally therefrom, through said slit.

8. The assembly of claim 7 wherein said locking element comprises a piece of material disposed within said marker member and attached thereto on one side of said slit, said piece of material extending across said slit with a free end portion thereof substantially bearing upon the inside surface of the marginal portion of said member on the opposite side of said slit, at least one of said piece of material and said marginal portion being resiliently deflectable so as to permit a guy cable to pass therebetween into the interior of said marker member.

9. A guy marker assembly comprising, in combination:

a mounting body with a longitudinal axis and opposite end portions thereon, said body having a longitudinal slot along one side providing a recess extending along the full length thereof, dimensioned to receive a guy cable therewithin disposed substantially on said axis, and having a groove extending entirely thereabout between said end portions and generally in a plane perpendicular to said axis thereof, one of said end portions of said body being of progressively diminishing cross sectional dimensions outwardly from said groove to one end thereof, to thereby provide a lead-in to said groove, over the surface of which said engagement element of said marker member can slide to facilitate coaxial mounting thereof upon said body;

means for attaching said mounting body to a guy cable so disposed, said attaching means comprising a preformed helical strap on said mounting body, said strap extending from said body with its helical axis substantially coaxial with said longitudinal axis thereof, said strap being adapted for wrapping about a guy cable for tightly gripping the same; and a tubular marker member coaxially mounted on said body and dimensioned and configured for rotation thereabout, said marker member having at least one inwardly projecting engagement element thereon slidably seated within said groove of said body, said engagement element engaging said marker member and body against relative axial displacement while permitting relative rotation therebetween.

10. The assembly of claim 9 wherein said marker member is fabricated from a resiliently deflectable material, and is slit along its full length.

11. The assembly of claim 10 wherein there are a plurality of said engagement elements, said elements being disposed at equidistantly spaced locations about said marker member and substantially in a common plane oriented perpendicular to the longitudinal axis thereof.

12. The assembly of claim 10 wherein said marker member has a locking element thereon for inhibiting withdrawal of a guy cable laterally therefrom, through said slit.

13. The assembly of claim 12 wherein said locking element comprises a piece of material disposed within said marker member and attached thereto on one side of said slit, said piece of material extending across said slit with a free end portion thereof substantially bearing upon the inside surface of the marginal portion of said member on the opposite side of said slit, at least one of said piece of material and said marginal portion being resiliently deflectable, so as to permit a guy cable to pass therebetween into the interior of said marker member.

* * * * *